US006782662B2

(12) United States Patent
McCartney et al.

(10) Patent No.: US 6,782,662 B2
(45) Date of Patent: Aug. 31, 2004

(54) MOVABLE BARRIER OPERATOR HAVING CABLE TENSION SENSOR AND DOOR LOCK MECHANISM

(75) Inventors: Phillip McCartney, Belvidere, IL (US); Robert E. Dutka, Glen Ellyn, IL (US); Andrew Gavel, Suffolk, NY (US); William Chen, Queens, NY (US); Robert J. Olmsted, Wood Dale, IL (US)

(73) Assignee: The Chamberlain Group, Inc., Elmhurst, IL (US)

( * ) Notice: Subject to any disclaimer, the term of this patent is extended or adjusted under 35 U.S.C. 154(b) by 0 days.

(21) Appl. No.: 10/128,095

(22) Filed: Apr. 23, 2002

(65) Prior Publication Data

US 2002/0184824 A1 Dec. 12, 2002

Related U.S. Application Data

(60) Provisional application No. 60/286,472, filed on Apr. 25, 2001.

(51) Int. Cl.[7] ..... E05D 15/38
(52) U.S. Cl. ..... 49/197
(58) Field of Search ..... 49/197, 199, 200, 49/322

(56) References Cited

U.S. PATENT DOCUMENTS

| | | | | |
|---|---|---|---|---|
| 2,185,828 A | | 1/1940 | Blodgett | |
| 3,785,089 A | | 1/1974 | Smith | |
| 4,385,471 A | | 5/1983 | Gabry et al. | |
| 4,520,591 A | | 6/1985 | Calvagno | |
| 5,743,046 A | * | 4/1998 | Siegler et al. | 49/199 |
| 5,803,149 A | * | 9/1998 | Halley et al. | 160/201 |
| 6,145,570 A | * | 11/2000 | Mullet et al. | 160/191 |
| 6,189,266 B1 | * | 2/2001 | Michalcheon | 49/322 |
| 6,279,268 B1 | * | 8/2001 | Beaudoin et al. | 49/322 |
| 6,325,134 B1 | * | 12/2001 | Mullet | 160/189 |
| 6,326,751 B1 | * | 12/2001 | Mullet et al. | 318/434 |
| 6,442,897 B1 | * | 9/2002 | Mullet | 49/199 |

FOREIGN PATENT DOCUMENTS

FR 2 634 815 A 7/1988

* cited by examiner

*Primary Examiner*—Jerry Redman
(74) *Attorney, Agent, or Firm*—Fitch, Even, Tabin & Flannery

(57) ABSTRACT

A cable tension sensing apparatus is mounted on a wall having a door opening. The jack shaft garage door operator includes a drive unit having an electric motor for driving a jack shaft mounted above a door opening. A pull-up cable drum is connected to the jack shaft and has a multi-strand steel pull-up cable that may be payed out to lower a door or wound up to raise the door. The cable tension sensing apparatus includes a cable guide to retain the cable a substantially fixed distance from the wall and a spring driven cable follower which urges against the cable extending between the drum periphery and the cable guide. An alerting switch is connected to the cable follower and sends a signal indicating loss of cable tension when the cable follower moves beyond a predetermined distance. Additionally, the movement of the cable follower moves a door blocking arrangement to a position to block movement of the door when being raised without use of the motor.

27 Claims, 8 Drawing Sheets

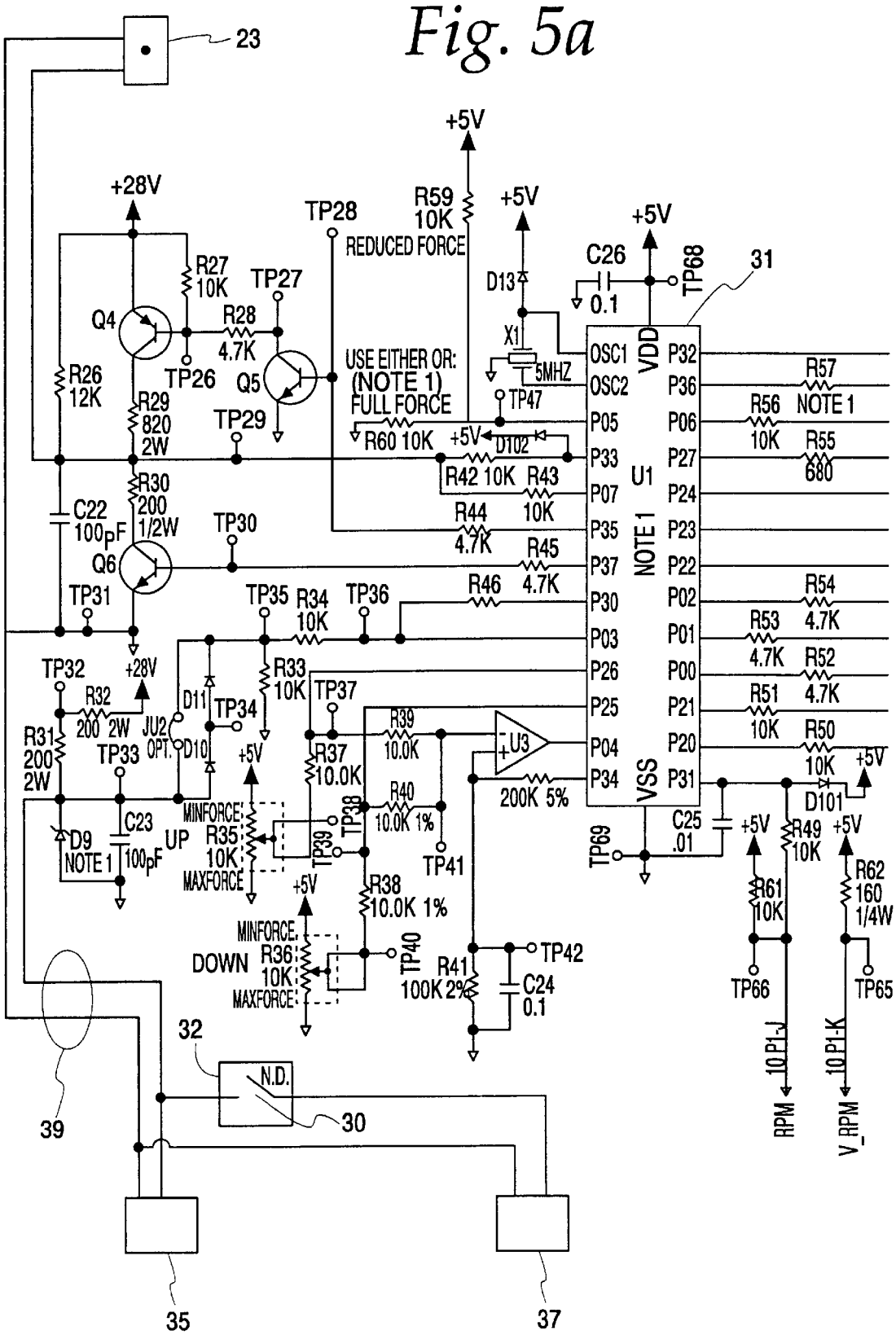
Fig. 5a
23
+5V
+28V
TP28
R59
10K
REDUCED FORCE
+5V
+5V
C26
0.1
TP68
31
R27
10K
TP27
D13
Q4
R28
4.7K
X1
5MHZ
OSC1
OSC2
VDD
P32
R57
R26
12K
TP26
Q5
USE EITHER OR:
(NOTE 1)
FULL FORCE
TP47
P36
R56
NOTE 1
R29
820
2W
TP29
R60 10K
+5V
D102
P05
P06
10K
R55
680
R30
200
1/2W
R42 10K
R43
10K
P33
P27
U1
C22
100pF
TP30
R44
4.7K
P07
P24
Q6
R45
4.7K
P35
P23
TP31
TP35
R34
10K
TP36
R46
4.7K
P37
P22
NOTE 1
R54
4.7K
P30
P02
R53
4.7K
P03
P01
TP32
+28V
R33
10K
TP37
P26
P00
R52
4.7K
R32
200 2W
D11
TP34
P25
P21
R51
4.7K
R31
200
2W
JU2
OPT.
D10
TP33
+5V
R39
10.0K
U3
P04
P20
10K
R50
10K
+5V
R37
10.0K
R40
10.0K 1%
P34
VSS
P31
200K 5%
D101
C23
100pF
D9
NOTE 1
UP
MINFORCE
R35
10K
MAXFORCE
TP39
TP38
TP41
TP69
C25
.01
+5V
R49
10K
+5V
+5V
R38
10.0K 1%
R61
10K
R62
160
1/4W
MINFORCE
DOWN
R36
10K
MAXFORCE
TP40
R41
100K 2%
TP42
C24
0.1
TP66
TP65
32
N.D.
30
39
10 P1-J
10 P1-K
RPM
V_RPM
35
37

| Fig. 5a | Fig. 5b |
|---|---|

MOVABLE BARRIER OPERATOR HAVING CABLE TENSION SENSOR AND DOOR LOCK MECHANISM

This application claims the benefit of Provisional Application No. 60/286,472 filed Apr. 25, 2001.

BACKGROUND OF THE INVENTION

The invention relates in general to barrier movement operators and in particular to a jack shaft garage door operator having a sensing apparatus for preventing cable associated with a pull-up cable drum from becoming slack during the operation of the door and for providing a positive door locking system.

One of the problems associated with jack shaft garage door operators is that while they are compact and may be conveniently used in garages which have little overhead room, they may present problems to the owners of the garage in that the cable may be payed out allowing the door to close under its own weight and if the door stalls or if the cable pay out drum rotates too far, the tension in the cable will drop and the cable may come off the drum necessitating a visit from a repairman. In addition, the jack shaft garage door operator does not provide any secure locking facility other than a lock at the bottom of the door, which may be tampered with by a burglar. If the door is not locked by some other means, the bottom lock may be forced or damaged and the door can be lifted open and the garage entered by an intruder.

U.S. Pat. No. 3,785,089 discloses a door operator having a winch member built into a tilting door and movable with it. A cable is attached to a wall member supporting the door and another end of the cable is connected to an extensible arm.

U.S. Pat. No. 2,185,828 discloses a catch for stopping a door from falling in the event that a sustaining cable or a counterbalance fails or breaks.

U.S. Pat. No. 4,385,471 discloses a door including a stopping member having a clip connection 29 which engages a cable. If the cable breaks, as shown in FIG. 4, the arm 27 rotates outwardly bringing a cam dog 26 having a plurality of teeth 32 into locking engagement with a roller 13a to prevent the roller 13a from moving, thereby suspending the door in position.

U.S. Pat. No. 4,520,591 to Calvagno discloses a system that is mechanically responsive to a break in a cable to prevent a door from falling.

French Patent No. 2634-815-A includes an "anti-drop" safety mechanism having a cam plate 21 on either side of the door equipped with a convex toothed edge to engage a bracket in case of door suspension failure. None of the aforementioned documents teach or disclose solutions for preventing a door from being opened or from stopping an operation of a garage door operator to cause it to reverse to take up cable which may have inadvertently been payed off a cable drum of a jack shaft door operator.

What is needed is an improved barrier movement operator that avoids unwanted problems with the cable coming off the drum and provides security for the user.

SUMMARY OF THE INVENTION

A jack shaft garage door operator is useful for opening and closing a movable barrier such as a garage door. The jack shaft garage door operator embodying the present invention includes a drive unit having an electric motor therein for driving a torsion shaft sometimes called a jack shaft. The jack shaft is mounted above a door opening and usually has coupled to it a spring, or the like, for providing a restoring force to the jack shaft to help raise the door and to support a portion of the weight of the door that is not supported by the L-shaped rails that a door usually rides in. A pull-up cable drum is connected to the jack shaft to be rotated thereby and has a multi-strand steel pull-up cable connected thereto that may be payed out to lower a door or wound up to raise the door. The pull-up cable is typically connected to a bottom portion of the door and, when wound up, will cause the door to rise along vertical portions of L-shaped rails. A cable tension sensing apparatus is mounted on a wall having a door opening. The cable tension sensing apparatus includes cable guide to retain the cable a substantially fixed distance from the wall and a spring driven cable follower which urges against the cable extending between the drum periphery and the cable guide. An alerting switch is connected to the cable follower and sends a signal indicating loss of cable tension when the cable follower moves beyond a predetermined distance. Additionally, the movement of the cable follower moves a door blocking arrangement to a position to block movement of the door when being raised without use of the motor.

In the event that the cable is inadvertently payed out, for instance, by the door having reached the bottom of its travel and the operator continuing to run, the cable follower is allowed to move away from the wall by reduced tension (slack) in the cable and moves far enough that the alerting switch operates to generate a signal to which the operator responds by reversing the motor to raise the door. The garage door operator may otherwise be a conventional jack shaft garage door operator. The cable tension sensing apparatus prevents the cable from coming off the cable drum. In addition, a door stop for preventing the garage door from opening is attached to an upper panel of the garage door and, when in the closed position, is beneath the cable tension sensing apparatus when the door is pulled downwardly by full tension on the cable. When the cable follower moves as tension lessens in the cable, a sliding member is moved away from the wall above the door. If the door is attempted to be breached, for instance by an intruder attempting to lift the door, the cable becomes slack allowing the sliding member to come out from the wall so that it then engages compressionally a stop plate on the garage door thereby preventing further upward motion of the garage door.

It is an aspect of the present invention to provide a jack shaft garage door operator having a cable tension sensor for providing door operator actions reversal to prevent cable paying off a cable drum.

It is another aspect of the present invention to provide a jack shaft garage door operator having a door opening block adapted to engage a sliding member to prevent a door from being forced open.

Other advantages of the invention will become obvious to one of ordinary skill in the art upon a perusal of the following specification and claims in light of the accompanying drawings.

BRIEF DESCRIPTION OF THE DRAWINGS

FIGS. 5*a*–5*b* is a circuit diagram showing portions of the electrical safety and control circuitry of the garage door opener;

DETAILED DESCRIPTION OF THE PREFERRED EMBODIMENT

Figure 1:
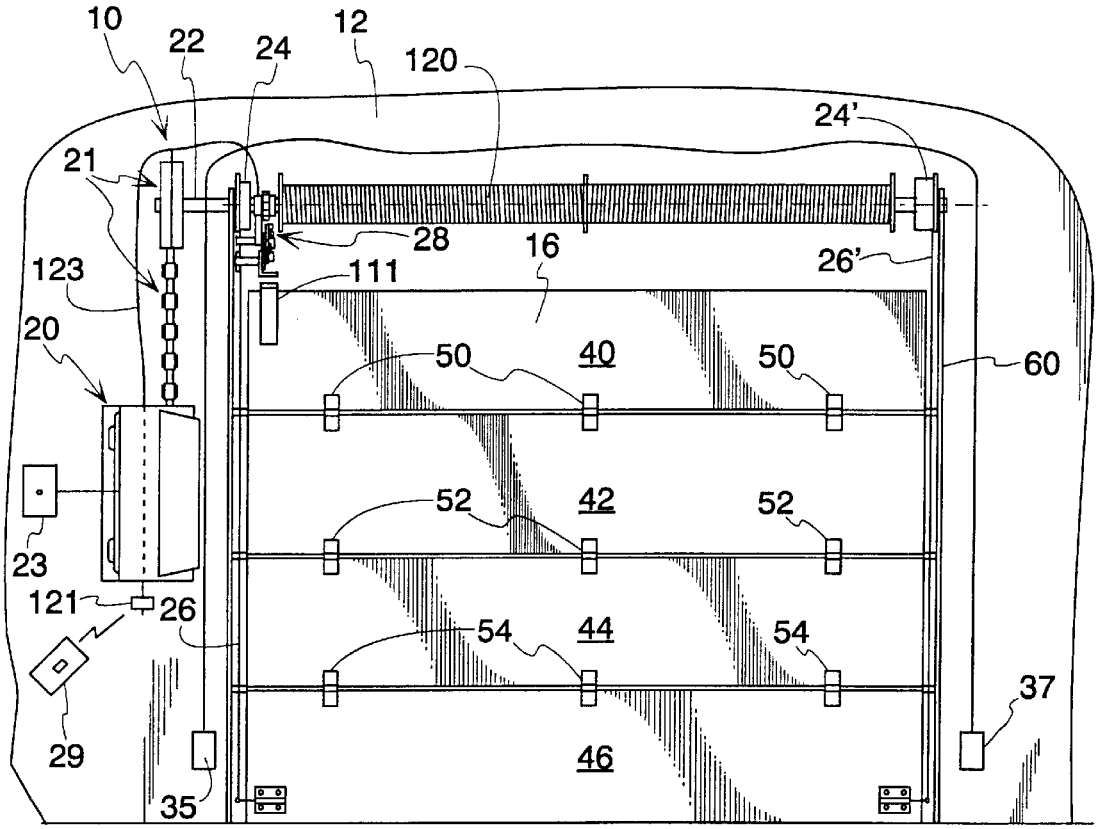
FIG. 1 is a plan view of a portion of a garage having a garage door in a closed position with a jack shaft garage door operator associated therewith.
Figure 8:
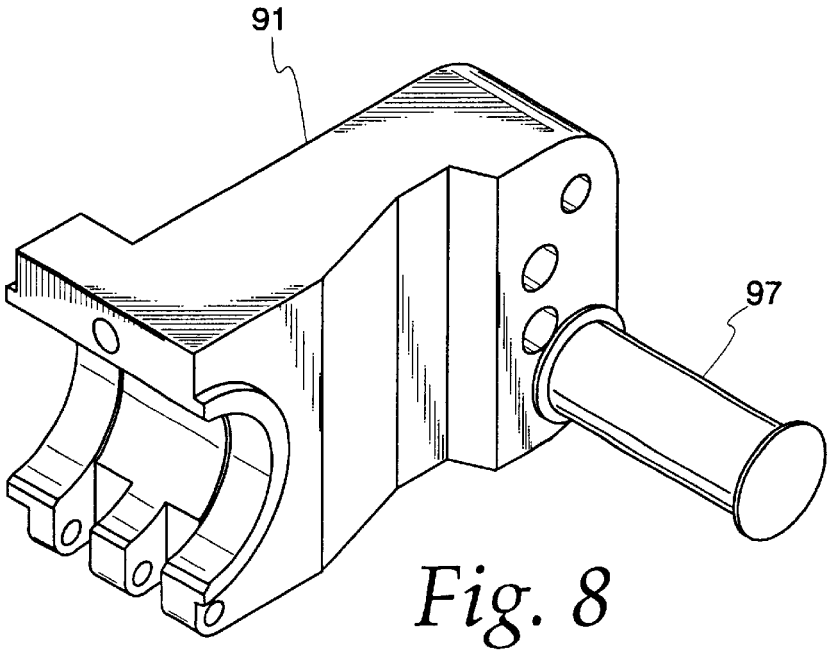
FIG. 8 is a perspective view of a portion of the pivot member and tension sensor.

Referring now to the drawings and especially to FIG. 1, a jack shaft garage door operator embodying the present invention and generally identified by numeral 10 is shown therein. The jack shaft garage door operator 10 is mounted on a garage wall 12 near a garage door opening which has associated with it a movable multiple panel garage door 16.

The jack shaft garage door operator 10 includes a drive unit 20 having a motor 25 (FIG. 5*b*) which is connected by a chain drive system 21 to a jack shaft 22. The motor 25 of drive unit 20 is energized in a well known manner to rotate the jack shaft 22. Cable drums 24 and 24' are mounted on the jack shaft 22 to be turned and respective pull-up cables 26 and 26' are wound around the cable drums 24 and 24' to be pulled upwardly. A cable tension assembly shown at 28 is mounted on the wall 12 of the garage immediately above the door 16 adjacent the jack shaft 22.

The garage door 16 is a multiple paneled door consisting of a plurality of rectangular panels 40, 42, 44 and 46. The panels 40 and 42 are connected by a plurality of hinges 50. Panels 42 and 44 are connected by a plurality of hinges 52. Panels 44 and 46 are connected by a plurality of hinges 54. The door is carried on a plurality of rollers in a pair of L-shaped tracks 60, when the door 16 is lowered, the jack shaft 22 is rotated to pay out the cables 26 and 26' from the pull-up cable drums 24 and 24'.

Figure 5B:
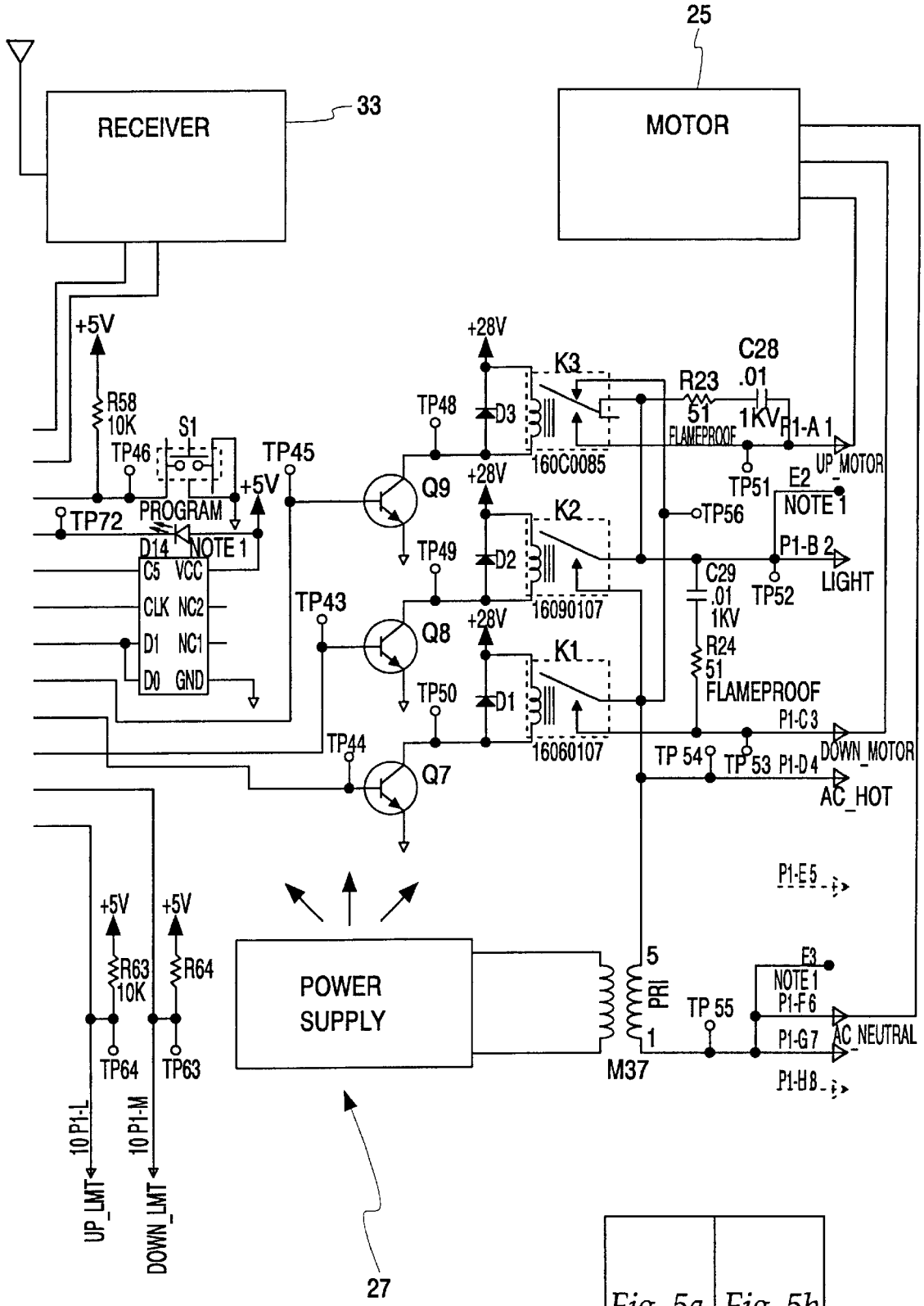

Drive unit 20 includes a controller 27 shown in detail in FIG. 5*a*–5*b* which responds to input signals to control the raising and lowering of door 16 by selectively stopping or energizing up and down rotation of motor 25. Controller 27 responds to standard input signals in a known manner to raise and lower the door. Pushing a button 23 when the door is open or closed will cause a processor 31 of controller 27 to energize the motor 25 to move the door to the other state. Similarly, receipt of a properly encoded signal from a remote transmitter 29 (FIG. 1) at a receiver 33 will result in the processor 31 causing the door to open or close.

The garage door operator includes infrared obstruction sensor apparatus comprising a transmitter 37 mounted on one side of the door and a receiver 35 mounted on the opposite side of the door. The transmitter 37 is aimed at the receiver 35 and transmits a recurring series of light pulses. The receiver 35 receives the light pulses and generates a series of electrical pulses on a conductor pair 39 connected to the controller 27. It should be mentioned that the controller 27 also provides DC power to the transmitter 37 and receiver 35 via the conductor pair 39 to power their operation. Whenever the transmitted light beams from transmitter 37 to receiver 35 are blocked, the pulses on conductor 39 are terminated by receiver 35. Processor 31 senses the stoppage of pulses and, when the door is traveling downward, the processor controls the motor 25 to stop and then to rotate to raise the door. Thus the door is kept from striking whatever is in the doorway blocking the light beam. The DC voltage which powers the operation of transmitter 37 is connected, in part, to transmitter 37 via a normally open contact 30 of a switch 32. The closed state of contact 30 is maintained when tension is present in cable 26. As is discussed later herein, when the tension in cable 26 decreases switch contact 30 opens and, the transmitter stops transmitting light pulses causing the pulses on conductors 39 to stop. As in the case of an optical obstruction, controller 31 responds to the stoppage of pulses on conductors 39 by raising the door when the door was traveling down.

Figure 2:
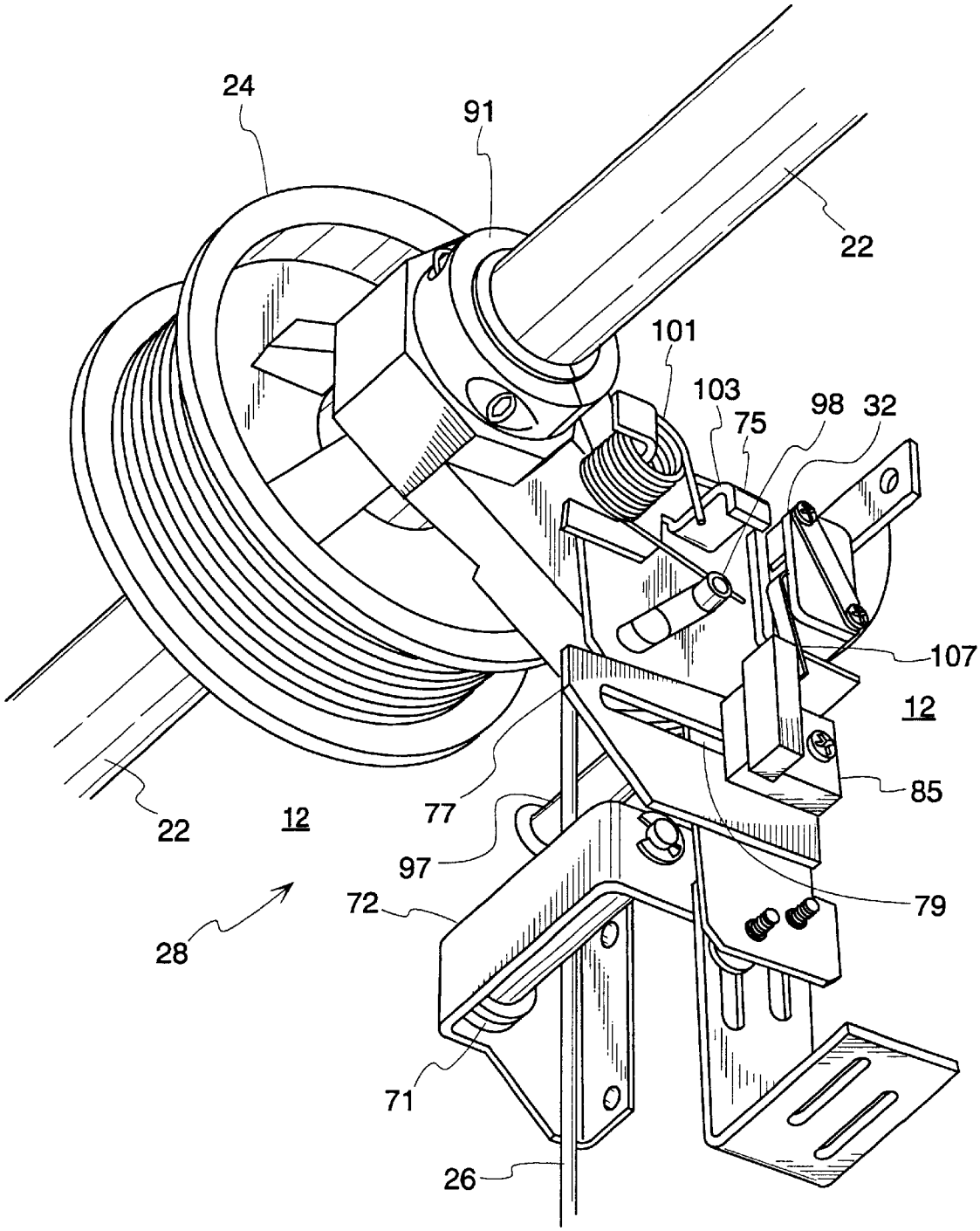
FIG. 2 is a perspective view showing details of a portion of the jack shaft garage door operator shown in FIG. 1.
Figure 3:
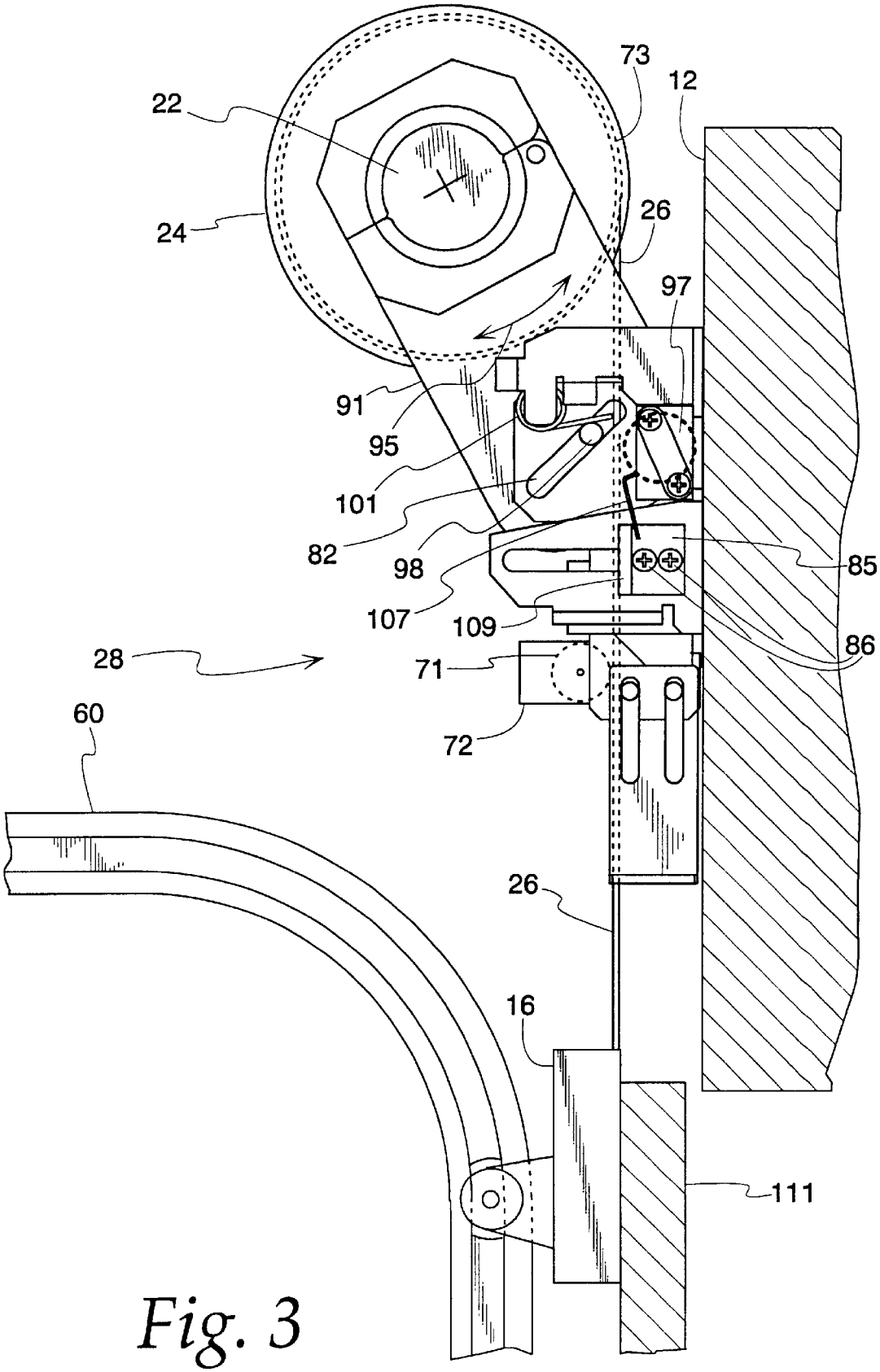
FIG. 3 is a side view of a portion of the jack shaft garage door operator.

FIG. 2 is a perspective view of cable tension assembly 28 as mounted to wall 12 near cable drum 24. Cable tension assembly 28 includes a cable guide roller 71 which is rotatably mounted to wall 12 in a roller frame 72. Cable 26 passes between roller 71 and wall 12. FIG. 3 is a plan view of the cable tension assembly as viewed outwardly from the center of the door 16. As shown in FIG. 3, roller 71 is rotatably held by assembly 72 at a distance from wall 12 which is substantially equal to the distance between wall 12 and the perimeter 73 of drum 24. Thus, the perimeter 73 of drum 24 and the roller 71 keep cable running substantially parallel to the surface of wall 12 when tension is present in the cable 26.

Figure 6:
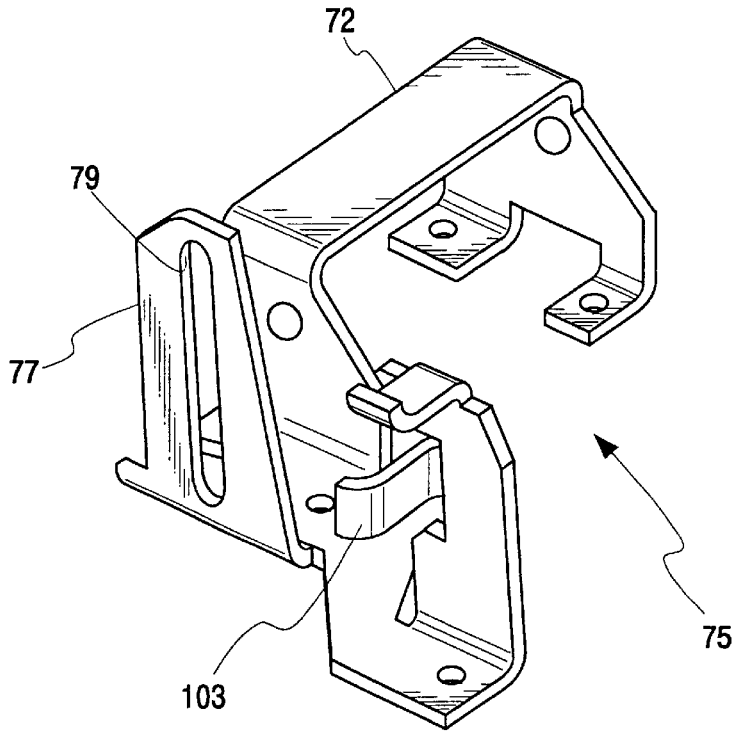
FIG. 6 is a perspective view of a frame used in the embodiment.
Figure 7:
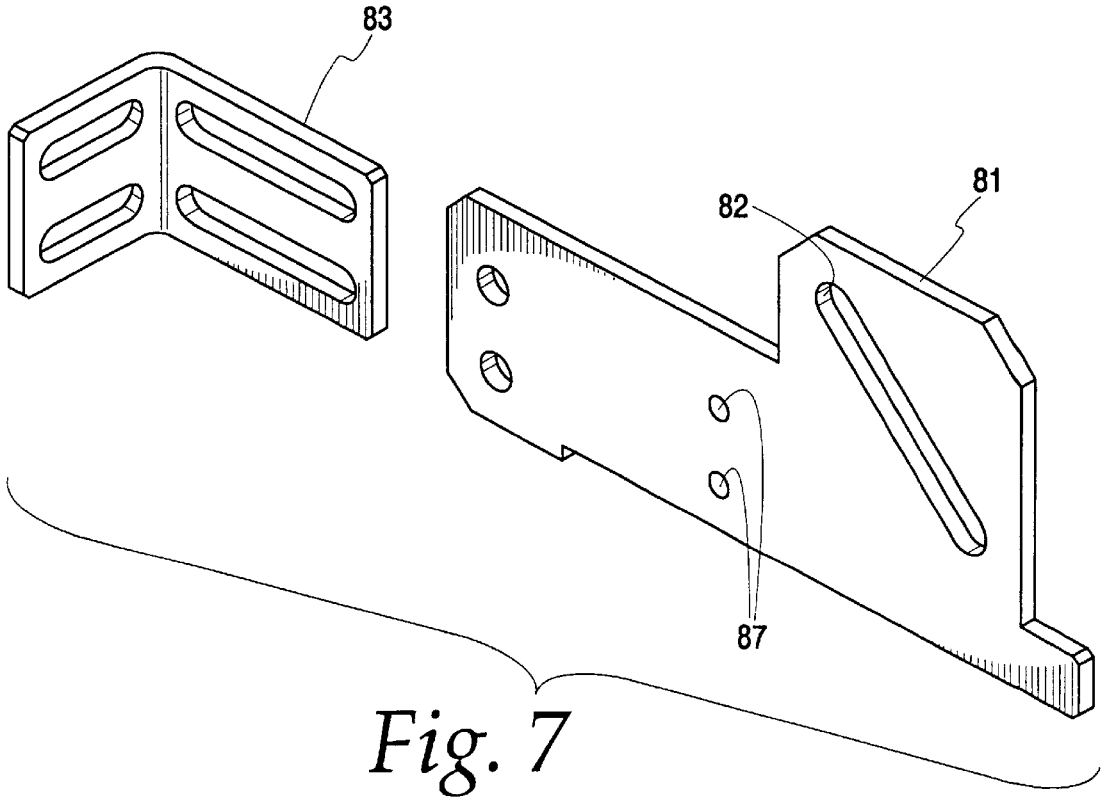
FIG. 7 is a perspective view of a sliding member and door stop of the embodiment.

Roller holding assembly 72 is a portion of a frame 75 (FIG. 6) which supports portions of the tension assembly 28. Frame 75 includes a portion 77 which is substantially normal to the surface of wall 12 and includes a slot 79 which is also normal to wall 12. Cable tension assembly 28 also includes a sliding member 81 (FIG. 7), which is slidably connected to frame 75 at slot 79 by means of a nylon slide 85. More specifically a pair of screws 86 secure nylon slide 85 to a front face of portion 77 by means of two holes 87 in sliding member 81. After such attachment, sliding member 81 on one side of portion 77 and nylon slide 85 on the other are free to move normally to wall 12 while trapped in slot 79. A doorstop 83 may also be attached to sliding member 81 to stop the raising of door 16 by means other than motor 25.

A cable tension sensing pivot member 91 is used to sense the tension in cable 26. Pivot member 91 is slidably mounted to jack shaft 22 and is free to rotate about the longitudinal axis of jack shaft 22 as represented by accurate arrow 95 (FIG. 3). Pivot member 91 includes a cable sensor 97 which, after mounting pivot member 91, is placed between cable 26 and wall 12. Pivot member 91 includes a protrusion 98 which after assembly of the cable tension apparatus 28 is slidably inserted into a slot 82 of sliding member 81. Rotational force is applied to pivot member 91 by a torsion spring 101 which is disposed between protrusion 98 and a tab 103 of frame 75. By the operation of spring 101 the pivot member 91 is urged to rotate in a clockwise direction as shown in FIG. 3.

It will be remembered that DC voltage is applied to the infrared transmitter 37 via the normally open contact 30 (FIG. 5*a*) of a switch 32. In FIG. 2, switch 32 is shown mounted to frame 75 and with a switch lever 107 disposed between a shelf 109 of nylon sliding member 85 and wall 12. When tension is present in cable 26 (FIG. 3) the cable tension follower 97 is urged against the force of spring 101 and maintained in a position shown in FIG. 3. In the "tensioned" position of FIG. 3 the switch lever 107 is held by sliding member 85 and switch contact 30 of switch 32 is kept in the closed state. Thus, when tension is present in cable 26 the infrared obstruction detection system operates in a normal, well known manner.

Figure 4:
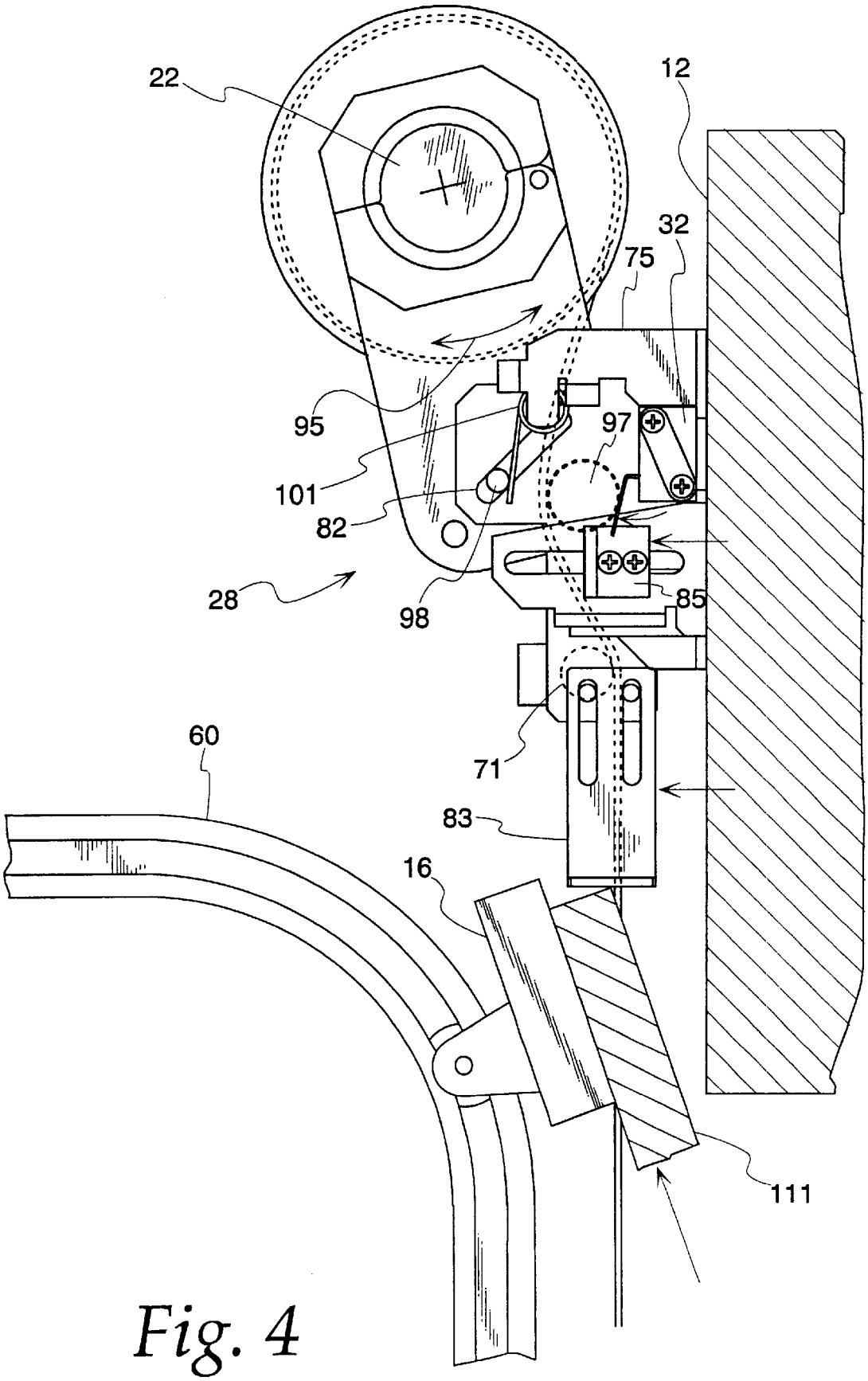
FIG. 4 is a side view, showing a cable tensioning member of the jack shaft garage door operator positioned to take up slack in a pull-up cable.

Alternatively, FIG. 4 shows the situation when the cable is not under tension such as would occur if the door 16 became stuck when being lowered or the motor continued to run after reaching the down limit. Without the counter force of cable tension on cable guide 97, spring 101 causes pivot member 91 to rotate clockwise to a position shown in FIG. 4. As pivot member 91 rotates, pin 98 moves within slot 82 causing sliding member 75 to move away from wall 12. The movement of sliding member 75 raises the switch lever 107 until switch contact 30 of switch 32 assumes its normally open state. The opening of switch contact 30 removes DC voltage from transmitter 37 which results in controller 27 sensing the absence of pulses on conductor 39. As described above, the controller 27 responds to the absence of pulses by controlling motor to raise door 16. When motor 25 begins to turn the jack shaft 22 to raise the door, tension will be restored in cable 26 and the configuration shown in FIG. 3 will again be achieved.

The raising of door 16 in response to a lack of cable tension occurs only when the door 16 is being lowered by motor 25. When the door is in the lowered/closed state, processor 31 does not respond to the removal of cable tension by energizing motor 25 to raise the door. This occurs because processor 31 is programmed to perform a remedial opening of the door 16 only when the door is being closed under the control of controller 27.

Should someone, such as a burglar, attempt to raise a door 16, which is in the closed state, the sliding member 81 and a door stop extension 83 provide protection. When the door is closed and an attempt to raise it is made, the cable 26 will go slack as shown in FIG. 4. The slack cable will result in sliding member 81 moving away from the wall 12. Affixed to sliding member 81 is a door stop 83 which moves translationally along with sliding member 81. A spacer block 111 (FIG. 1) is attached to the inside of the top panel 40 of the door 16 and strikes the door stop 83 which stops the door from further movement. Alternatively, when the door is being raised by the motor, tension is present in the cable and, as shown in FIG. 3, the door stop is retained near wall 12. The block 111 will freely pass the door stop 83 when it is held near the wall 12.

Figure 9:
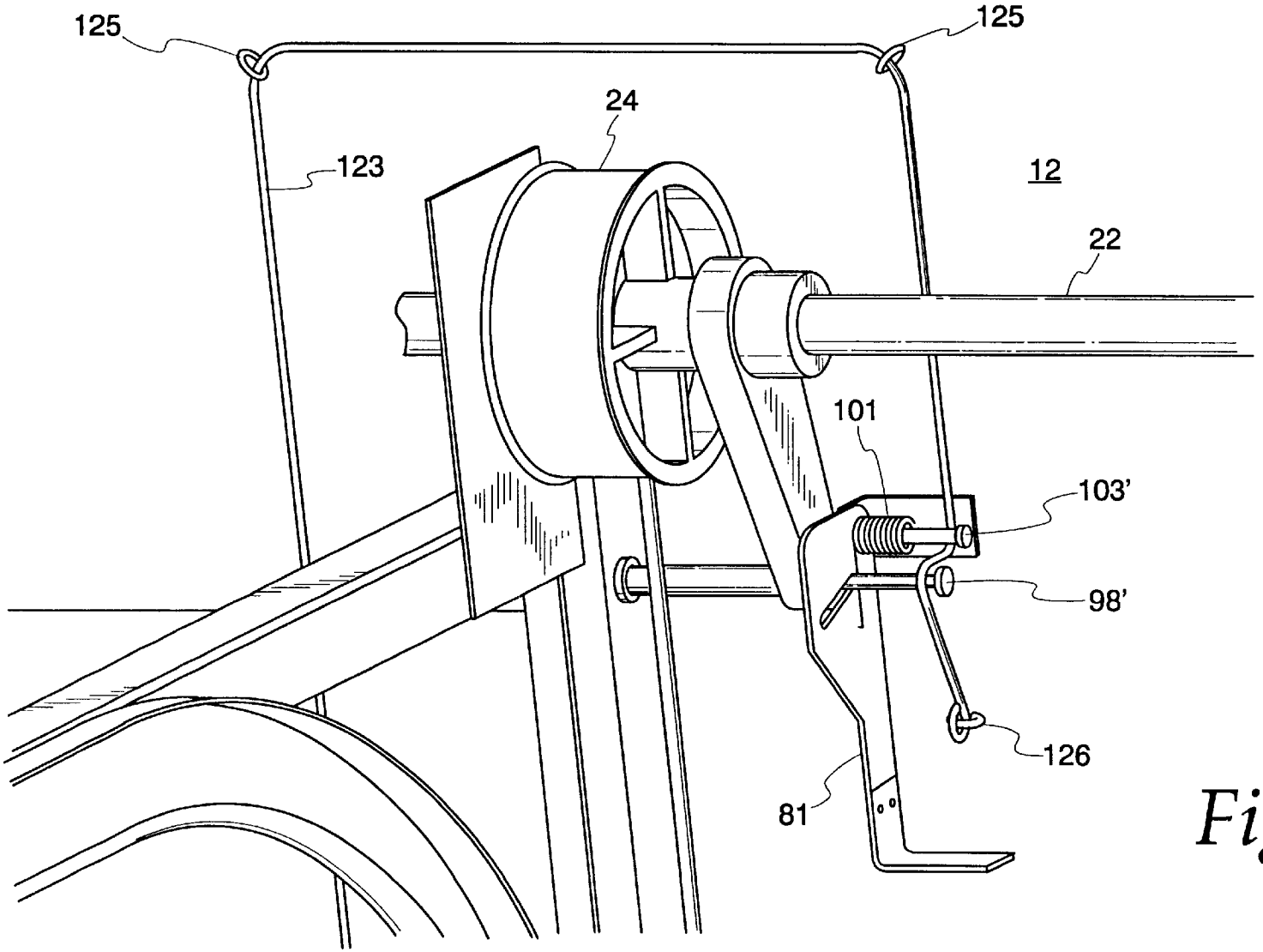
FIG. 9 is a perspective view of a tension sensor disabling apparatus.

Under certain conditions, such as the door spring 120 breaking or coming loose, the door 16 may be closed and tension is removed from the cable 26. This might result in a blocked door as represented in FIG. 4. To prevent such, an emergency release control is provided whereby a person inside the garage can raise the door. The release control includes a release cable or rope 123 and handle 121 as represented in FIGS. 1 and 9. In FIG. 9 the cable tension assembly 28 has been simplified for ease of understanding. When the emergency release is present, the protrusion 98 is extended and is shown as 98' in FIG. 9. Also the spring holding member 103' is formed to more easily allow the rope or cable 123 to slide passed.

The emergency release (FIG. 9) includes a cable or rope 123 connected to a user operated handle 121 at a free end and running up through guides 125 which are affixed to the wall 12. The guides 125 retain the rope 123 in place and allow a 180° change in the rope's direction of movement. Rope 123 extends between the spring retainer 103' and the wall 12 and passes over protrusion 98' away from wall 12. The rope 123 is then tied to an anchor 126. When the door block is to be manually controlled, an operator pulls downwardly on handle 121 which tightens cable 123 and moves protrusion 98' and sliding member 81 back toward the wall 12 freeing tube door 16 to be raised. Advantageously, rope 123 may also be attached to a clutch in opener 20 to release the motor 25 from the chain assembly 21 to ease the manual raising of the door.

The preceding description is intended to be illustrative of the principles of the invention and modifications can be made to the embodiment and still be within the scope of the invention recited in the appended claims. For example, the torsion spring 120 of the preceding embodiment could be replaced by a counter weight. Further, the distance between the wall and cable tension assembly might be varied by the use of a shim to avoid the use of member 111 attached to door 16.

What is claimed is:

1. In an arrangement for moving a barrier with respect to an opening in a wall, a safety arrangement comprising:

motor driven apparatus for extending and retracting a cable attached to the barrier;

first cable guide for retaining the cable at substantially first predetermined distance from the wall;

second cable guide spaced apart from the first cable guide for retaining the cable at second predetermined distance from the wall;

cable tension sensing apparatus contacting the cable between the first and the second cable guide apparatus for generating a signal when slack is detected in the cable; and a controller responding to the signal from the cable tension sensing apparatus for controlling movement of the barrier.

2. A safety arrangement in accordance with claim 1, wherein the motor driven apparatus comprises a cable take up/pay out drum, and the first cable guide comprises a perimeter of the drum.

3. A safety arrangement in accordance with claim 2, wherein the barrier is raised and lowered by the motor driven apparatus, and the second cable guide is disposed on the wall beneath the cable drum.

4. A safety arrangement in accordance with claim 3, wherein the first and the second predetermined distances are substantially the same.

5. A safety arrangement in accordance with claim 4, wherein the cable tension sensing apparatus comprises a spring biased contact arm contacting the cable from between the cable and the well.

6. A safety arrangement in accordance with claim 5, wherein the cable tension sensing apparatus comprises a signal generator for generating a signal when the contact arm is urged a predetermined distance from the wall by the bias spring.

7. A safety arrangement in accordance with claim 6, wherein the signal generator comprises electrical switch contacts.

8. A safety arrangement in accordance with claim 5, wherein the motor driven apparatus comprises a torsion shaft driven by a motor to rotate the cable drum.

9. A safety arrangement in accordance with claim 8, wherein the torsion shaft has a longitudinal axis, and the contact arm pivots about the longitudinal axis of the torsion shaft.

10. A safety arrangement in accordance with claim 3 comprising obstruction sensing apparatus.

11. A safety arrangement in accordance with claim 10, comprising circuitry responsive to sensing of an obstruction for controlling the motor to raise the barrier upon sensing an obstruction.

12. A safety arrangement in accordance with claim 11, wherein the cable tension sensing apparatus is connected to the obstruction sensing apparatus.

13. A safety arrangement in accordance with claim 11, wherein a signal generated by the cable tension sensing apparatus emulates obstruction signals generated by the obstruction sensing apparatus.

14. A safety arrangement in accordance with claim 3 comprising a sliding apparatus moved by the cable tension sensing apparatus for blocking a barrier being raised without use of the motor.

15. A safety arrangement in accordance with claim 3 comprising a barrier blocking apparatus for blocking a barrier being raised without use of the motor and a user operated override to disable blockage of barrier movement by the blocking apparatus.

16. A safety apparatus in accordance with claim 15 comprising a spring responsive to lack of cable tension by moving the barrier blocking apparatus into blocking engagement with the barrier.

17. A safety apparatus in accordance with claim 16 comprising user operated apparatus operating against the spring to move the barrier blocking apparatus out of blocking engagement with the barrier.

18. In an arrangement for moving a barrier with respect to an opening in a wall, a safety arrangement comprising:

motor driven apparatus for extending and retracting a cable attached to the barrier;

a cable guide for retaining the cable at a predetermined distance from the wall;

attachment apparatus for connecting the cable to the barrier to be moved;

cable tension sensing apparatus contacting the cable between the cable guide apparatus and the attachment apparatus for generating a signal when slack is detected in the cable; and a controller responding to the signal from the cable tension sensing apparatus for controlling movement of the barrier.

19. A safety arrangement in accordance with claim 18, wherein the motor driven apparatus comprises a cable take up/pay out drum, and the cable guide comprises a perimeter of the drum.

20. A safety arrangement in accordance with claim 19, wherein the barrier is raised and lowered by the motor driven apparatus, which is energized by the controller.

21. A safety arrangement in accordance with claim 20, wherein the cable under tension is substantially parallel to and spaced at the predetermined distance from the wall.

22. A safety arrangement in accordance with claim 21, wherein the cable tension sensing apparatus comprises a spring biased contact arm contacting the cable from between the cable and the wall.

23. A safety arrangement in accordance with claim 22, wherein the cable tension sensing apparatus comprises a signal generator for generating a signal when the contact arm is urged away from the wall by the bias spring responsive to lack of cable tension.

24. A safety arrangement in accordance with claim 23, wherein the signal generator comprises electrical switch contacts.

25. A safety arrangement in accordance with claim 24, wherein electrical switch contact opens when the contact arm moves away from the wall.

26. A safety arrangement in accordance with claim 25, wherein the controller is responsive to switch contact opening by controlling the motor to reverse movement and raise the barrier.

27. A safety arrangement in accordance with claim 25, wherein the controller is responsive to switch contact opening by blocking the barrier to prevent raising from its lowered/closed position.

* * * * *